US010100851B2

(12) United States Patent
Watanabe

(10) Patent No.: US 10,100,851 B2
(45) Date of Patent: Oct. 16, 2018

(54) PNEUMATIC ACTUATOR

(71) Applicant: Mitsubishi Electric Corporation, Tokyo (JP)

(72) Inventor: Shingo Watanabe, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 15/510,199

(22) PCT Filed: Nov. 25, 2014

(86) PCT No.: PCT/JP2014/081088
§ 371 (c)(1),
(2) Date: Mar. 9, 2017

(87) PCT Pub. No.: WO2016/084130
PCT Pub. Date: Jun. 2, 2016

(65) Prior Publication Data

US 2017/0306992 A1 Oct. 26, 2017

(51) Int. Cl.
*F01B 31/00* (2006.01)
*F15B 15/10* (2006.01)

(52) U.S. Cl.
CPC ..... *F15B 15/10* (2013.01)

(58) Field of Classification Search
CPC ..... B60T 17/086; F16D 65/14; F15B 15/10
USPC ..... 188/153 D, 170; 92/63, 130 A
See application file for complete search history.

(56) References Cited

U.S. PATENT DOCUMENTS

| | | | | |
|---|---|---|---|---|
| 4,729,290 | A * | 3/1988 | Ewald | B60T 17/086 92/130 A |
| 6,314,861 | B1 * | 11/2001 | Smith | B60T 17/083 92/130 A |
| 6,477,939 | B1 * | 11/2002 | Siebke | B60T 17/083 92/130 R |
| 2004/0036204 | A1 | 2/2004 | Aubarede et al. | |
| 2004/0250678 | A1 | 12/2004 | Bonotto et al. | |
| 2013/0312840 | A1 * | 11/2013 | Young | F16K 31/1221 137/15.19 |
| 2014/0069361 | A1 | 3/2014 | Watanabe | |
| 2015/0136534 | A1 | 5/2015 | Faller | |

FOREIGN PATENT DOCUMENTS

| | | | |
|---|---|---|---|
| DE | 28 16 640 | C2 | 10/1979 |
| DE | 3907152 | A1 | 9/1989 |
| DE | 202004009313 | U1 | 9/2004 |
| DE | 10 2005 003 613 | A1 | 7/2006 |
| DE | 102013204957 | A1 | 9/2013 |
| EP | 24 12 820 | A1 | 9/1975 |
| JP | 58-38568 | A | 3/1983 |
| JP | 62-80307 | A | 4/1987 |
| JP | 2002-537164 | A | 11/2002 |
| JP | 2012-67800 | A | 4/2012 |
| JP | 2013-185670 | A | 9/2013 |
| JP | 2014-51925 | A | 3/2014 |

* cited by examiner

*Primary Examiner* — Christopher P Schwartz
(74) *Attorney, Agent, or Firm* — Birch, Stewart, Kolasch & Birch, LLP

(57) ABSTRACT

A spring provided in a pneumatic actuator is held by a spring holder. A winding tip portion of the spring is bent inwardly. The spring holder includes a spring guide having a part that is depressed and formed as a depressed portion. Rotation of the spring is prevented by disposing the winding tip portion of the spring in the depressed portion of the spring holder.

9 Claims, 7 Drawing Sheets

PNEUMATIC ACTUATOR

TECHNICAL FIELD

The invention relates to a pneumatic actuator.

BACKGROUND ART

A pneumatic actuator operates in response to an air pressure supplied.

For example, Patent Literature 1 describes a pneumatic actuator in which air supplied to a cylinder pushes a piston to move a piston rod forward, and a biasing force of a compressed spring pushes the piston to return the piston rod backward.

CITATION LIST

Patent Literature

Patent Literature 1: Japanese Patent Application Laid-open No. 2012-67800

SUMMARY OF INVENTION

Technical Problem

An operation characteristic of the pneumatic actuator can be represented by the relationship between supplied air pressure and rod stroke. Hereinbelow, the above operation characteristic is simply referred to as a characteristic.

Incidentally, during the operation of the pneumatic actuator, the spring is not only compressed but also bent. When the spring is bent, it exerts restoring force against the bending. The restoring force is a factor that influences the characteristic of the pneumatic actuator.

Further, values of the restoring force of the spring against the bending depend on a direction in which the spring is bent. In the conventional pneumatic actuator described in Patent Literature 1, no considerations have been given to prevent the spring from rotating. Accordingly, during operation of the pneumatic actuator, the spring rotates, and the direction of the bending varies. As a result, the influence exerted on the characteristic by the restoring force to the bending changes according to the variation each time, and unexpected sudden change of the characteristic occurs.

Thus, there has been a problem that the characteristic becomes unstable in the pneumatic actuator. When the characteristic is unstable, the operation of the pneumatic actuator is not stabilized and controllability deteriorates.

The invention has been made in order to solve the above problem, and an object thereof is to obtain the pneumatic actuator capable of stabilizing the characteristic.

Solution to Problem

A pneumatic actuator according to the invention includes a housing into which air pressure is to be applied; a spring holder, provided within the housing, to perform a reciprocal movement along with a diaphragm by the air pressure to be applied; a rod attached to the spring holder and reciprocally movable along with the spring holder; a spring, provided within the housing, and contractable and extendable by the reciprocal movement of the spring holder to provide a biasing force; and a rotation limiting portion for limiting rotation of the spring.

Advantageous Effects of Invention

According to the invention, a characteristic of the pneumatic actuator is stabilized.

DESCRIPTION OF EMBODIMENTS

Hereinbelow, in order to describe the invention in greater detail, embodiments will be described according to the accompanying drawings.

Embodiment 1

Figure 1:
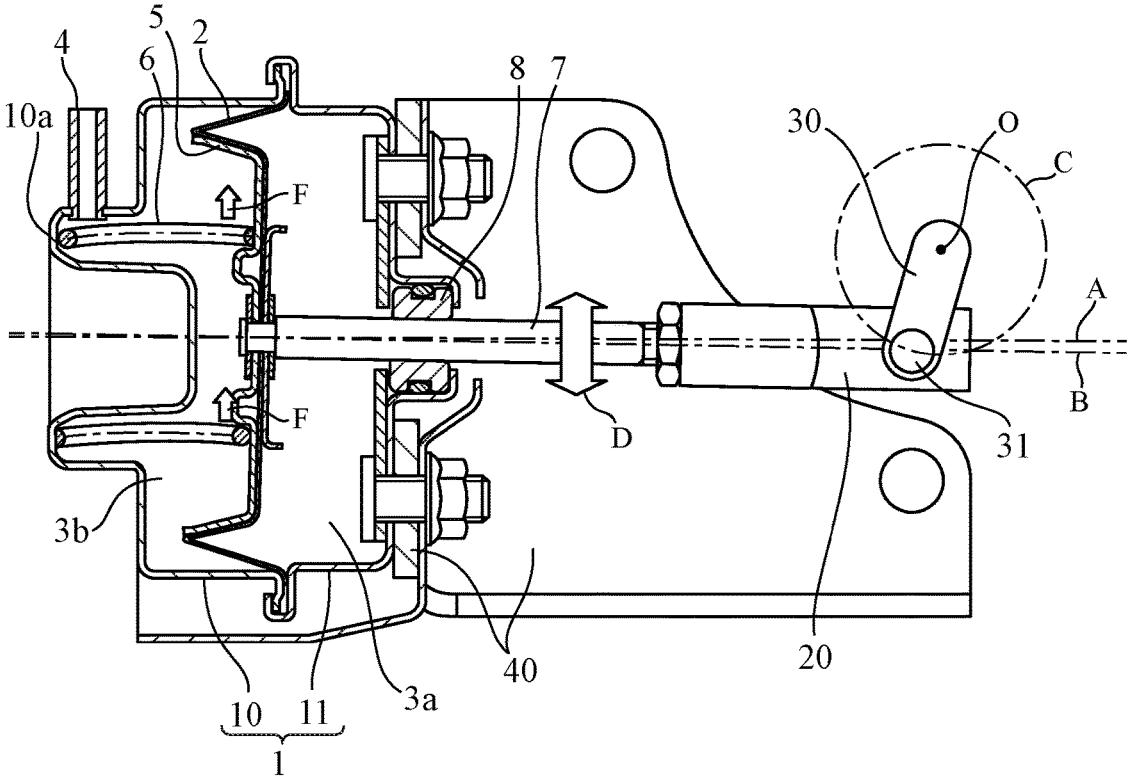
FIG. 1 is a cross-sectional view of a pneumatic actuator according to Embodiment 1 of the invention.

FIG. 1 is a cross-sectional view of a pneumatic actuator according to Embodiment 1 of the invention, and shows, as an example, the case where the pneumatic actuator is mounted to a turbocharger.

The pneumatic actuator includes a housing 1 that is formed into a box-like shape with a first housing 10 and a second housing 11. Inside the housing 1, there is provided a disk-shaped diaphragm 2 that is made of, for example, rubber. The diaphragm 2 is provided such that the peripheral edge portion thereof is sandwiched between the first housing 10 and the second housing 11, and divides the inside of the housing 1 into an atmospheric pressure chamber 3*a* and a negative pressure chamber 3*b*. The atmospheric pressure chamber 3*a* is open to the atmosphere via an atmospheric hole that is not shown. Negative pressure is applied to the negative pressure chamber 3*b* via a negative pressure introduction pipe 4 mounted to the first housing 10.

On the surface of the diaphragm 2 that is on the side of the negative pressure chamber 3*b*, there is provided a dish-shaped spring holder 5 made of, e.g., iron. The spring holder 5 holds one end portion of a spring 6. The spring 6 is held by the spring holder 5 in a state in which rotation of the spring 6 about its axis is prevented. The other end portion of the spring 6 is held by a bottom surface 10*a* of the first housing 10 that opposes the spring holder 5. The spring 6 is obtained by spirally winding a linear member made of, e.g., iron.

Fixed to the spring holder 5 is one end portion of a rod 7. The rod 7 passes through the second housing 11, and the other end portion thereof is exposed to the outside. The rod 7 is held by a bearing portion 8 provided inside the second housing 11 so as to be slidable in an axial direction.

Out of the end portions of the rod 7, the end portion that is exposed to the outside is connected to a lever 30 of the turbocharger, which is not shown, via a length adjusting arm 20. The outer peripheral surface of the exposed end portion of the rod 7 is formed with a male screw, while the length adjusting arm 20 is formed with a female screw. The entire length of the rod 7 and length adjusting arm 20 may be adjusted by adjusting the screwing amount of the male and female screws. The lever 30 is mounted to the length adjusting arm 20 with a pin shaft 31, and pivots about a rotation center O.

The turbocharger is an apparatus for sending a large amount of air into an internal combustion engine by using exhaust gas of the internal combustion engine. The pneumatic actuator operates the lever 30 by moving the rod 7 in the axial direction, and controls the operation of the turbocharger by controlling the exhaust gas taken in by the turbocharger.

The second housing 11 is screwed to a bracket 40, and the pneumatic actuator is thereby fixed to the bracket 40.

Next, the operation of the pneumatic actuator will be described.

When the negative pressure is applied to the negative pressure chamber 3*b*, the diaphragm 2 except for the peripheral edge portion, and the spring holder 5 provided on the diaphragm 2 compress the spring 6 and move in a direction in which the capacity of the negative pressure chamber 3*b* is reduced. In response to this, the rod 7 moves in the pull-in direction, that is, in the direction in which the rod 7 is pulled in toward the inside of the housing 1. As a result, the lever 30 of the turbocharger pivots clockwise in FIG. 1 about the rotation center O.

On the other hand, when the negative pressure applied to the negative pressure chamber 3*b* is reduced, the diaphragm 2 except for the peripheral edge portion, and the spring holder 5 provided on the diaphragm 2 move in a direction in which the capacity of the negative pressure chamber 3*b* is increased with a biasing force exerted by the spring 6 that extends from its compressed state. In response to this, the rod 7 moves in the push-out direction, that is, in the direction in which the rod 7 is pushed out toward the outside of the housing 1. As a result, the lever 30 of the turbocharger pivots counterclockwise in FIG. 1 about the rotation center O.

Thus, the lever 30 of the turbocharger performs pivoting movement about the rotation center O in response to the movement of the rod 7. An arc-shaped path taken by the lever 30 in the pivoting movement is part of a circle C in FIG. 1. Accordingly, strictly speaking, there are cases where the rod 7 moves not only along a central axis A of the pneumatic actuator shown in FIG. 1 but also along an inclined axis B that is inclined relative to the central axis A. That is, the rod 7 swings in the direction D that is perpendicular to the central axis A, as shown in FIG. 1.

In the case where the rod 7 swings and its axis does not correspond to the central axis A and is inclined toward the inclined axis B, the spring holder 5 is tilted and the spring 6 is bent. At this point, the spring 6 generates a restoring force F to eliminates the bending. With the restoring force F, a resistance force in a direction perpendicular to the central axis A is generated between the rod 7 and the bearing portion 8, and the characteristic of the pneumatic actuator is thereby influenced.

Figure 2A:
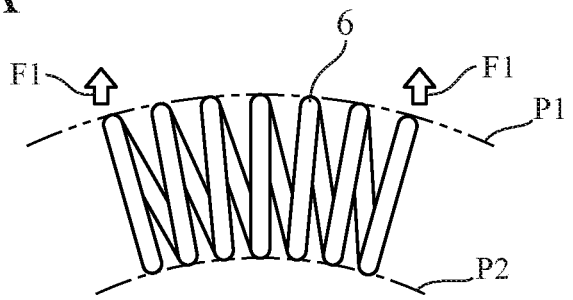
FIGS. 2A-2C illustrate views which are used to explain restoring forces exerted when a spring is bent.
Figure 2B:
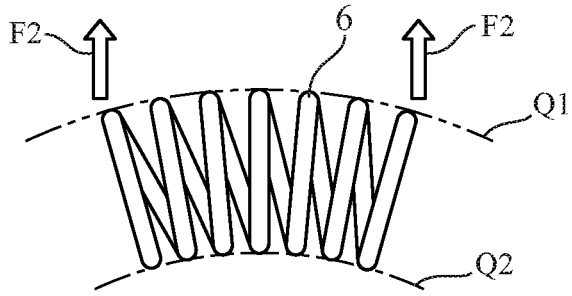

The restoring force F of the spring 6 will be described using FIG. 2. FIGS. 2A and 2B are plan views when the spring 6 is viewed from different directions. FIG. 2A shows a state in which the spring 6 is bent in such a manner that the portion of the spring 6 along the axis line P1 is expanded, and that the portion along the axis line P2 is compressed. FIG. 2B shows a state in which the spring 6 is bent in such a manner that the portion of the spring 6 along an axis line Q1 is expanded, and that the portion along an axis line Q2 is compressed.

Figure 2C:
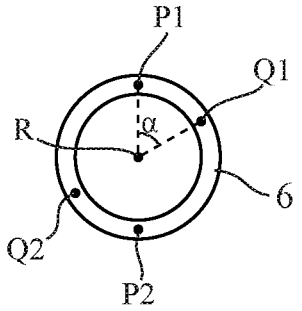

The positional relationship among the axis lines P1, P2, Q1, and Q2 is as shown in FIG. 2C. FIG. 2C is a plan view when the spring 6 that is not bent is viewed from the axial direction. Note that, in FIG. 2C, the depiction of the winding end portion of the spring 6 is omitted for simplification, and hence the spring 6 is simply shown as an annular ring.

The axis line P1 opposes the axis line P2 with reference to the central axis R of the spring 6. Similarly, the axis line Q1 opposes the axis line Q2 with reference to the central axis R of the spring 6. In addition, the axis line P1 is apart from the axis line Q1 by an angle $\alpha$ when viewed from the central axis R. The angle $\alpha$ takes a value other than 0, and hence the axis line P1 and the axis line Q1 are not the same axis line.

In the case where the spring 6 is bent in a direction shown in FIG. 2A, a restoring force F1 is generated at each end portion of the spring 6. In the case where the spring 6 is bent in a direction shown in FIG. 2B, a restoring force F2 is generated at each end portion of the spring 6. The spiral spring 6 cannot have a completely symmetrical shape due to the presence of the winding tip portion or other causes, and hence the restoring force F1 and the restoring force F2 do not have the same value. In the shown examples, the value of the restoring force F2 in the case where the spring 6 is bent in the direction shown in FIG. 2B is larger than that of the restoring force F1.

Thus, the restoring force generated in the spring 6 differs depending on the direction of the bending.

Note that, in FIG. 1, the depiction of the restoring force generated at the end portion of the spring 6 on the side of the bottom surface 10*a* is omitted. This is because the influence of the restoring force generated at the end portion on the side of the bottom surface 10*a* over the resistance force, which is generated between the rod 7 and the bearing portion 8 in the direction perpendicular to the central axis A, is small.

Figure 3:
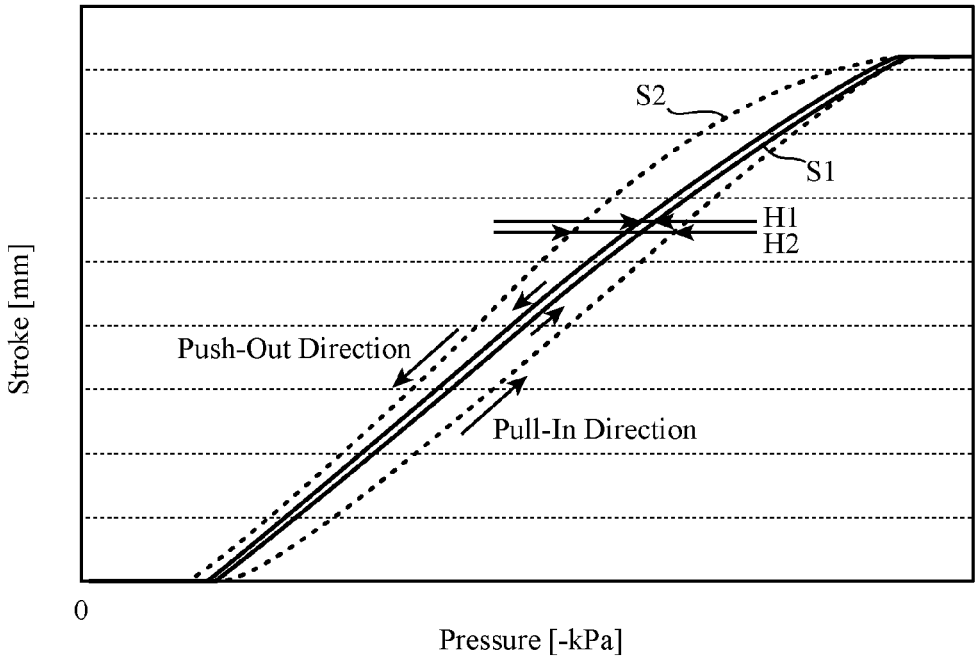
FIG. 3 is a graph showing a characteristic of the pneumatic actuator.

FIG. 3 is a graph showing characteristics of the pneumatic actuator. The horizontal axis represents air pressure of negative pressure that is applied, while the vertical axis represents the stroke of the rod 7. The characteristic includes the influence by the restoring force generated by bending the spring 6. FIG. 3 shows characteristics in the case where the spring 6 is bent in different directions.

A characteristic S1 indicated by solid lines is obtained in the case where the spring 6 is bent, e.g., in the direction of FIG. 2A. A characteristic S2 indicated by dotted lines is obtained in the case where the spring 6 is bent, e.g., in the direction of FIG. 2B.

As shown in FIG. 3, in the case of each of the characteristics S1 and S2, the characteristic when the rod 7 moves in the pull-in direction and the characteristic when the rod 7 moves in the push-out direction are different from each other. The characteristic differs depending on the movement direction of the rod 7 because the biasing force of the spring 6 generated in the axial direction of the rod 7 functions as resistance to the movement when the rod 7 moves along the pull-in direction, and functions so as to assist the movement when the rod 7 moves along the push-out direction.

Further, even in the case of the same movement direction of the rod 7, the characteristic S1 and the characteristic S2 show different loci. In the case of the pull-in direction of the rod 7, the amount of change in stroke of the rod 7 is defined with respect to the position at which the stroke is 0. When the rod 7 is pulled in, even when the same pressure is applied, the amount of change in stroke of the rod 7 is larger in the characteristic S1 than in the characteristic S2. In the case of the push-out direction of the rod 7, the amount of change in stroke of the rod 7 is defined with respect to a stroke maximum position at which the rod 7 is pulled in to the maximum extent. When the rod 7 is pushed out, even when the same pressure is applied, the amount of change in stroke of the rod 7 is larger in the characteristic S1 than in the characteristic S2. In addition, with regard to a difference in air pressure resulting from the movement directions of the rod 7, a difference H2 in the case of the characteristic S2 is larger than a difference H1 in the case of the characteristic S1. This is because, as shown in FIG. 2, the restoring force of the spring 6 generated when the spring 6 is bent in the direction of FIG. 2B is larger than that generated when it is bent in the direction of FIG. 2A. That is, the larger restoring force increases the resistance force that is generated between the rod 7 and the bearing portion 8 in the direction perpendicular to the central axis A, which results in a large resistance experienced by the rod 7 when it moves.

Note that, hereinbelow, the difference in air pressures resulting from the movement directions of the rod 7 is referred to as hysteresis.

As described above, the spring 6 provided in the pneumatic actuator according to the present invention is restricted from rotating about its axis. Here, assume that the spring 6 is provided in a state in which the rotation of the spring 6 about its axis is not prevented. In this state, the spring 6 rotates about the axis due to, for example, vibrations from the outside or the operation of the pneumatic actuator itself. As a result, for example, even if the pneumatic actuator is operated to show the locus corresponding to the characteristic S1 when the negative pressure is applied and the rod 7 starts moving in the pull-in direction, the spring 6 may rotate during the operation and the pneumatic actuator may operate to show the locus corresponding to the characteristic S2. Further, assumed that an operation of a cycle in which the rod 7 is pulled in to the maximum extent from the position at which the stroke is 0 and the rod 7 is returned to the position at which the stroke is 0 from the position at which the rod 7 is pulled in to the maximum extent has been performed, and that the operation of this cycle is performed again. If the spring 6 rotates during a period from the end of the first cycle to the beginning of the second cycle, operations would be performed according to different characteristics during the first and second cycles. Thus, the characteristic of the pneumatic actuator may change suddenly and unexpectedly, and the characteristic becomes unstable.

In contrast to this, when the rotation of the spring 6 is prevented, such an unstable characteristic is not exhibited. For example, when the rotation is prevented such that the spring 6 is bent in the direction of FIG. 2A, the characteristic S1 shown in FIG. 3 is uniquely determined as the characteristic and, when the rotation is prevented such that the spring 6 is bent in the direction of FIG. 2B, the characteristic S2 shown in FIG. 3 is uniquely determined as the characteristic. That is, the characteristic is stabilized.

Hereafter, several configurations for preventing the rotation of the spring 6 will be described specifically.

Figure 4A:
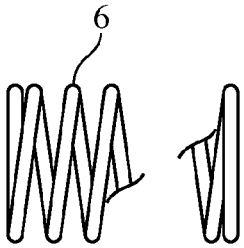
FIGS. 4A and 4B are plan views of the spring.
Figure 4B:
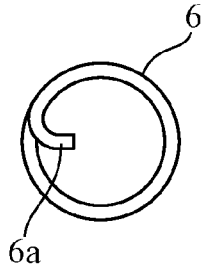

FIG. 4 shows plan views of the spring 6. FIG. 4A is a plan view when the spring 6 is viewed from the side. FIG. 4B is a plan view when the spring 6 is viewed from the axial direction. As shown in FIG. 4B, a winding tip portion 6*a* of the spring 6 is bent inwardly of the spring 6. The winding tip portion 6*a* is an end portion of a linear member that is spirally wound and forms the spring 6.

Figure 5:
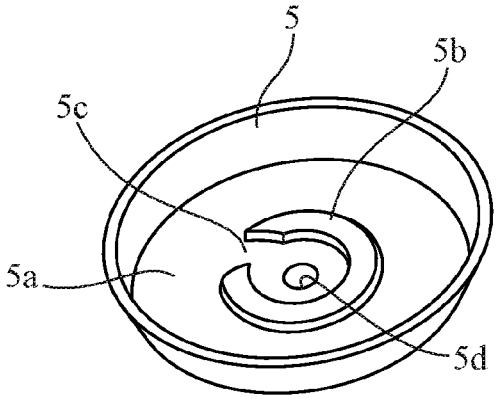
FIG. 5 is a perspective view of a spring holder.

FIG. 5 is a perspective view of the spring holder 5. The spring holder 5 is a dish-shaped member, and a spring guide 5*b* is provided on a disk surface 5*a*. The spring guide 5*b* is a convex portion that is formed in a shape following the inner periphery of the spring 6 in order to position the spring 6 in a radial direction. Part of the spring guide 5*b* is depressed to form a depressed portion 5*c*.

Note that a hole 5*d* at the center of the disk surface 5*a* is a hole for mounting the rod 7.

Figure 6:
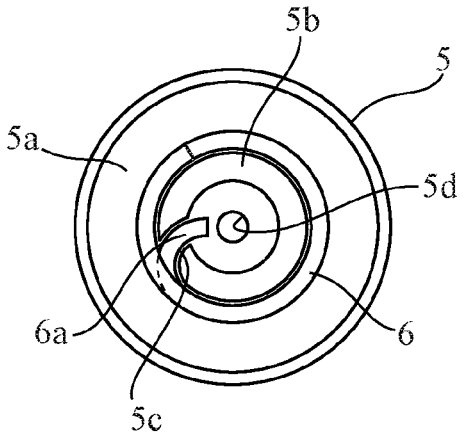
FIG. 6 is a plan view showing a state in which the spring shown in FIG. 4 is held by the spring holder shown in FIG. 5.

FIG. 6 is a plan view showing a state in which the spring 6 is held by the spring holder 5. The winding tip portion 6*a* of the spring 6 is disposed in the depressed portion 5*c* of the spring guide 5*b*, and the rotation of the spring 6 is thereby prevented.

The spring guide 5*b* is provided on the disk surface 5*a* by press molding. Alternatively, the spring guide 5*b* may also be provided by bonding a member having a shape corresponding to the spring guide 5*b* to the flat disk surface 5*a*.

Note that, the spring holder 5 or the spring 6 may be modified to have a shape shown in FIGS. 7-15. In FIGS. 7-15, portions identical or equivalent to those in FIGS. 4-6 are designated by the same reference numerals, and the description thereof will be omitted or simplified.

Figure 7A:
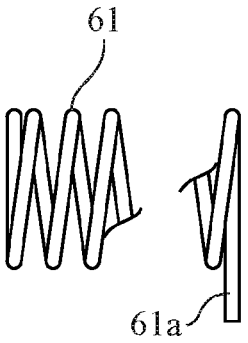
FIGS. 7A and 7B are plan views showing Modification 1 of the spring.
Figure 7B:
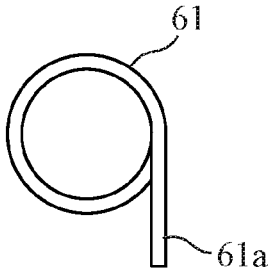

For example, instead of the spring 6, a spring 61 shown in FIG. 7 may be used. FIG. 7A is a plan view when the spring 61 is viewed from the side. FIG. 7B is a plan view when the spring 61 is viewed from the axial direction. In the spring 61, a winding tip portion 61*a* is extended to the outside of the spring 61. More specifically, the winding tip portion 61*a* extends in a direction of a tangent of a circle formed by the spring 6 when viewed from the axial direction.

Figure 8:
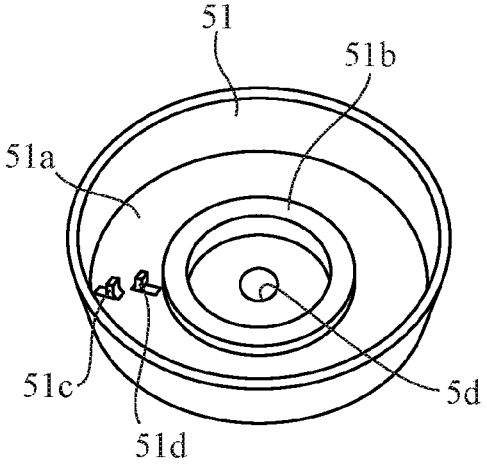
FIG. 8 is a perspective view showing Modification 1 of the spring holder.

When the spring 61 is used, instead of the spring holder 5, a spring holder 51 shown in a perspective view in FIG. 8 may be used. A spring guide 51*b* is provided on a disk surface 51*a* of the spring holder 51 in order to position the spring 61 in the radial direction. The spring guide 51*b* is a convex portion that is annularly formed along the inner periphery of the spring 61. On the disk surface 51*a*, claws 51*c* and 51*d* are provided so as to stand.

The claws 51*c* and 51*d* are provided on the disk surface 51*a* by press molding. Alternatively, the claws 51*c* and 51*d* may also be provided by bonding blocks having shapes corresponding to the claws 51*c* and 51*d* to the flat disk surface 51*a*.

Figure 9:
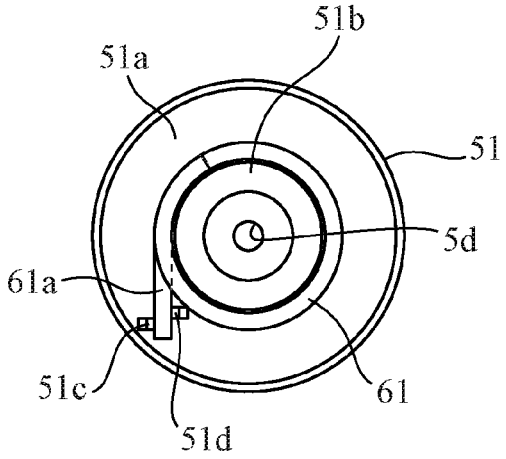
FIG. 9 is a plan view showing a state in which the spring shown in FIG. 7 is held by the spring holder shown in FIG. 8.

FIG. 9 is a plan view showing a state in which the spring 61 is held by the spring holder 51. The claws 51*c* and 51*d* of the spring holder 51 are positioned on both sides of the winding tip portion 61*a* of the spring 61, the claws 51*c* and

51*d* abut on the winding tip portion 61*a*, and the rotation of the spring 61 is thereby prevented.

Figure 10:
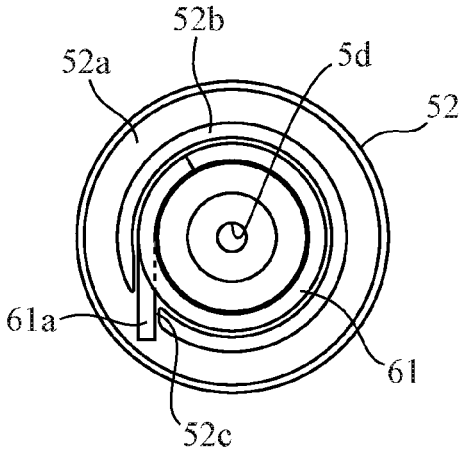
FIG. 10 is a plan view showing a state in which the spring shown in FIG. 7 is held by the spring holder of Modification 2.

In the case of the spring 61, as shown in a plan view in FIG. 10, the rotation may be prevented by a spring holder 52. A spring guide 52*b* that is positioned on the outer periphery of the spring 61 is provided on a disk surface 52*a* of the spring holder 52. The spring guide 52*b* is a convex portion that is formed so as to run along the outer periphery of the spring 61 in order to position the spring 61 in the radial direction. Part of the spring guide 52*b* is depressed to form a depressed portion 52*c*. The winding tip portion 61*a* of the spring 61 is disposed in the depressed portion 52*c*, and the rotation of the spring 61 is thereby prevented.

Figure 11:
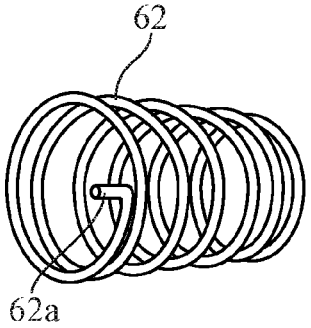
FIG. 11 is a perspective view showing Modification 2 of the spring.

Further, instead of the spring 6, a spring 62 shown in a perspective view in FIG. 11 may be used. In the spring 62, a winding tip portion 62*a* protrudes in the axial direction of the spring 62.

Figure 12:
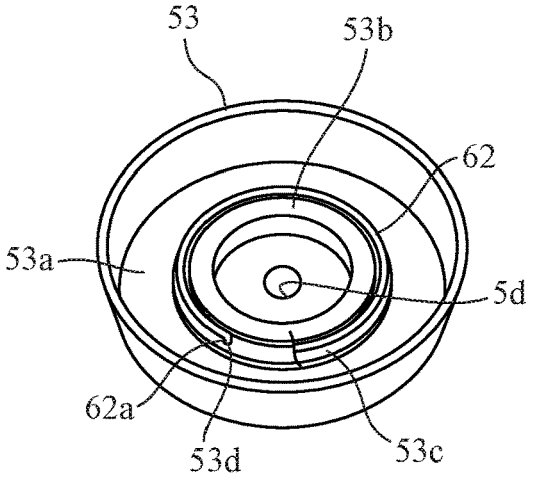
FIG. 12 is a perspective view showing a state in which the spring shown in FIG. 11 is held by the spring holder of Modification 3.

When the spring 62 is used, instead of the spring holder 5, a spring holder 53 shown in a perspective view in FIG. 12 may be used. On a disk surface 53*a* of the spring holder 53, a raised portion 53*c* that is raised annularly is provided. Further, a spring guide 53*b* is provided on the raised portion 53*c* in order to position the spring 62 in the radial direction. The spring guide 53*b* is a convex portion that is annularly formed along the inner periphery of the spring 62. An insertion hole 53*d* for inserting the winding tip portion 62*a* is formed in the raised portion 53*c*.

As shown in FIG. 12, the spring 62 is placed on the raised portion 53*c*, and the winding tip portion 62*a* is inserted into the insertion hole 53*d*. With this, the rotation of the spring 62 is prevented.

Note that the raised portion 53*c* is provided in order to prevent the winding tip portion 62*a* inserted into the insertion hole 53*d* from protruding to the side of the diaphragm 2 to damage the diaphragm 2.

Figure 13:
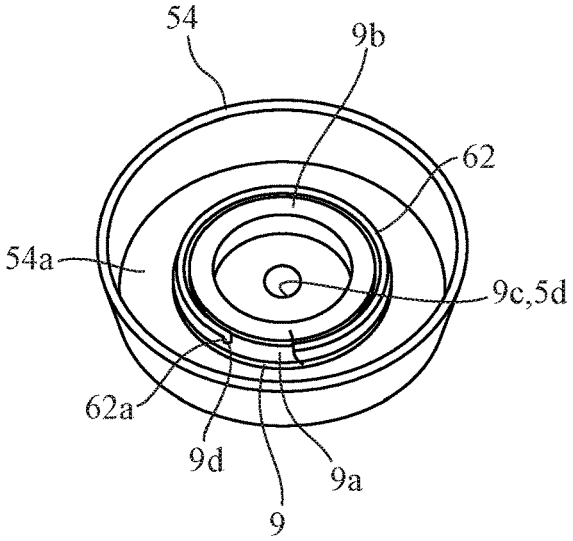
FIG. 13 is a perspective view showing a state in which the spring shown in FIG. 11 is held by the spring holder of Modification 4.

In the case of the spring 62, as shown in a perspective view in FIG. 13, the rotation may also be prevented by a spring holder 54 provided with a raised member 9. A disk surface 54*a* of the spring holder 54 is flat, and the raised member 9 is placed.

The raised member 9 includes a disk-shaped raised portion 9*a* and a guide portion 9*b* provided on the raised portion 9*a*. The guide portion 9*b* is a convex portion that is annularly formed along the inner periphery of the spring 62 in order to position the spring 62 in the radial direction. A hole 9*c* for mounting the rod 7 is formed at the center of the raised portion 9*a*. In addition, an insertion hole 9*d* for inserting the winding tip portion 62*a* is formed in the portion of the raised portion 9*a* positioned at the outer periphery of the guide portion 9*b*.

As shown in FIG. 13, the spring 62 is placed on the raised portion 9*a*, and the winding tip portion 62*a* is inserted into the insertion hole 9*d*. With this, the rotation of the spring 62 is prevented. In addition, as in FIG. 12, it is possible to prevent damage to the diaphragm 2.

Figure 14:
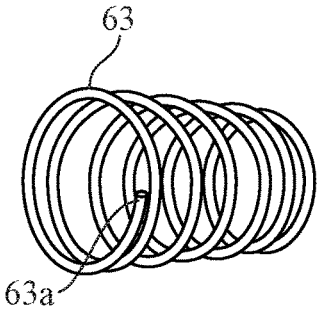
FIG. 14 is a perspective view showing Modification 3 of the spring.

Instead of the spring 6, a spring 63 shown in a perspective view in FIG. 14 may also be used. The spring 63 is a so-called common spring. Unlike the winding tip portions 6*a*, 61*a*, and 62*a*, a winding tip portion 63*a* forms a regularly spiral shape continuously with the portion of the spring 63 other than the winding tip portion 63*a*.

Figure 15:
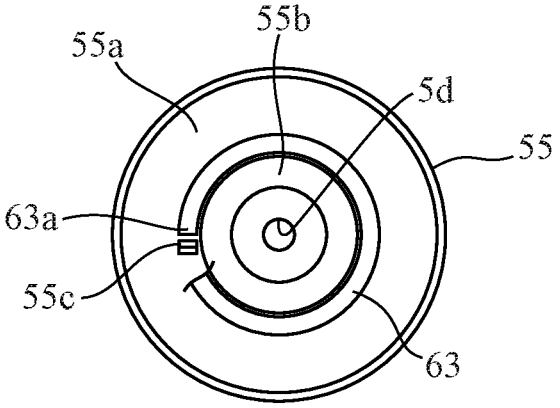
FIG. 15 is a perspective view showing a state in which the spring shown in FIG. 14 is held by the spring holder of Modification 5.

When the spring 63 is used, instead of the spring holder 5, a spring holder 55 shown in a plan view in FIG. 15 may be used. A spring guide 55*b* is provided on a disk surface 55*a* of the spring holder 55 in order to position the spring 63 in the radial direction. The spring guide 55*b* is a convex portion that is annularly formed along the inner periphery of the spring 63. A protruding claw 55*c* is provided on the disk surface 55*a*. The claw 55*c* is provided on the disk surface 55*a* by press molding. Alternatively, the claw 55*c* may also be provided by bonding a block having a shape corresponding to the claw 55*c* to the flat disk surface 55*a*.

As shown in FIG. 15, the claw 55*c* abuts on the tip surface of the winding tip portion 63*a* of the spring 63, and the rotation of the spring 63 is thereby prevented.

Note that the configuration shown in FIG. 15 in which the tip surface of the winding tip portion 63*a* opposes the claw 55*c* may also be applied to the spring 61 shown in FIG. 7. In this case, the claw 55*c* is provided at a position that opposes the tip surface of the winding tip portion 61*a* of the spring 61.

The claw 55*c* is not able to prevent the rotation of the spring 63 in a direction in which the winding tip portion 63*a* moves away from the claw 55*c*. That is, the claw 55*c* is the configuration that is effective only for the rotation in one direction. However, when the pneumatic actuator is mounted to another apparatus such as the turbocharger and is used, there are cases where the spring 63 rotates only in one direction due to vibrations to the pneumatic actuator or the like. In these cases, by providing the claw 55*c*, it is possible to prevent the rotation of the spring 63 extremely simply and efficiently.

By preventing the rotation of the spring provided in the pneumatic actuator by using one or more of the above-described configurations, the characteristic of the pneumatic actuator is stabilized.

Note that the configurations for preventing the rotation described above are only exemplary, and any configuration other than the above configurations may be adopted appropriately as long as the configuration is capable of preventing the rotation of the spring.

In the foregoing, the case where the rotation of the spring is prevented on the side of the spring holder has been described. However, the rotation of the spring may be prevented on the side of the first housing 10.

For example, it is possible to apply to the first housing 10 the configuration such as the rotation limitation by the insertion hole 9*d* and the winding tip portion 62*a* shown in FIG. 13 or the rotation limitation by the claw 55*c* and the winding tip portion 63*a* shown in FIG. 15.

Note that, in the foregoing, configurations in which the characteristic of the pneumatic actuator is stabilized by preventing the rotation of the spring have been described.

As shown in FIGS. 2 and 3, the restoring force generated when the spring is bent and the hysteresis change depending on whether the rotation is prevented at the position at which the spring is bent in the direction of FIG. 2A or the rotation is prevented at the position at which the spring is bent in the direction of FIG. 2B. The smaller the hysteresis is, the more preferable the hysteresis is. It is also preferable to set the hysteresis at least to a value that is not more than a permissible value permitted in use of the pneumatic actuator. Consequently, it is still more preferable to position the spring in the rotation direction, i.e., to prevent the rotation of the spring in such a manner that the spring may be bent in the direction in which the restoring force generated suppresses the hysteresis to have a value of not more than the permissible value. Actually, the correspondence between the bending direction of the spring and the hysteresis is successively determined by, e.g., a simulation or an experiment, bending directions in which the hysteresis is not more than the permissible value are determined, and the spring is positioned in a rotation direction in such a manner that the spring is bent in one of the determined bending directions.

In this manner, it is possible to operate the pneumatic actuator at all times under the characteristic in which the hysteresis is not more than the permissible value.

Thus, according to the pneumatic actuator according to Embodiment 1, the rotation of the spring is prevented. Consequently, it is possible to stabilize the characteristic of the pneumatic actuator.

For example, the winding tip portion 6*a* of the spring 6 is bent inwardly, and the convex spring guide 5*b* is formed along the inner periphery of the spring 6 in the spring holder 5. The depressed portion 5*c*, which is obtained by depressing part of the spring guide 5*b* and in which the winding tip portion 6*a* is disposed, corresponds to a rotation limiting portion. With this configuration, it is possible to stabilize the characteristic of the pneumatic actuator.

In addition, the raised portions 53*c* and 9*a* that are provided in the spring holders 53 and 54, and the spring guide 53*b* or the guide portion 9*b* that is disposed on the raised portion 53*c* or 9*a* and formed convexly along the inner periphery of the spring 62, are provided, and the winding tip portion 62*a* of the spring 62 protrudes in the axial direction. The insertion holes 53*d* and 9*d*, which are formed in the raised portions 53*c* and 9*a* and into which the winding tip portion 62*a* is inserted, correspond to the rotation limiting portions. With this configuration, it is possible to stabilize the characteristic of the pneumatic actuator.

Further, in the spring holders 51 and 55, the convex spring guides 51*b* and 55*b* are formed along the inner peripheries of the springs 61 and 63. The claws 51*c*, 51*d*, and 55*c*, which are formed in the spring holders 51 and 55 and abut on the winding tip portions 61*a* and 63*a* of the springs 61 and 63 to prevent the rotations of the springs 61 and 63, correspond to the rotation limiting portions. With this configuration, it is possible to stabilize the characteristic of the pneumatic actuator.

Furthermore, the winding tip portion 61*a* is extended to the outside of the spring 61, and the claws 51*c* and 51*d* are formed on both sides of the winding tip portion 61*a*. With this configuration, it is possible to stabilize the characteristic of the pneumatic actuator.

Moreover, the winding tip portion 61*a* of the spring 61 is extended to the outside, and the convex spring guide 52*b* is formed along the outer periphery of the spring 61 in the spring holder 52. The depressed portion 52*c*, which is obtained by depressing part of the spring guide 52*b* and in which the winding tip portion 61*a* is disposed, corresponds to the rotation limiting portion. With this configuration, it is possible to stabilize the characteristic of the pneumatic actuator.

Additionally, the spring is positioned in the rotation direction such that the hysteresis as the difference in the air pressure resulting from the operation direction of the rod 7 is not more than the permissible value. Consequently, it is possible to operate the pneumatic actuator under the stable characteristic in which the hysteresis is small.

Note that it is possible to modify any components in the embodiment, or omit any components in the embodiment within the scope of the invention of the present application.

INDUSTRIAL APPLICABILITY

Since the pneumatic actuator according to the invention is capable of stabilizing the characteristic, the pneumatic actuator is suitably used as, e.g., a drive apparatus that gives a driving force to a turbocharger to control its operation.

REFERENCE SIGNS LIST

1 housing
2 diaphragm
3*a* atmospheric pressure chamber
3*b* negative pressure chamber
4 negative pressure introduction pipe
5 spring holder
5*a* disk surface
5*b* spring guide
5*c* depressed portion
5*d* hole
6 spring
6*a* winding tip portion
7 rod
8 bearing portion
9 raised member
9*a* raised portion
9*b* guide portion
9*c* hole
9*d* insertion hole
10 first housing
10*a* bottom surface
11 second housing
20 length adjusting arm
30 lever
31 pin shaft
40 bracket
51 spring holder
51*a* disk surface
51*b* spring guide
51*c* claw
51*d* claw
52 spring holder
52*a* disk surface
52*b* spring guide
52*c* depressed portion
53 spring holder
53*a* disk surface
53*b* spring guide
53*c* raised portion
53*d* insertion hole
54 spring holder
54*a* disk surface
55 spring holder
55*a* disk surface
55*b* spring guide
55*c* claw
61 spring
61*a* winding tip portion
62 spring
62*a* winding tip portion
63 spring
63*a* winding tip portion

The invention claimed is:

1. A pneumatic actuator comprising:

a housing into which air pressure is to be applied;

a spring holder, provided within the housing, to perform a reciprocal movement along with a diaphragm by the air pressure to be applied;

a rod attached to the spring holder and reciprocally movable along with the spring holder;

a spring, provided within the housing, and contractable and extendable by the reciprocal movement of the spring holder to provide a biasing force; and a rotation limiting portion for limiting rotation of the spring, wherein a convex portion is formed in the spring holder, along an inner periphery of the spring, and the rotation limiting portion comprises a claw that is formed in the spring holder, and abuts on a winding tip portion of the spring to limit the rotation of the spring.

2. The pneumatic actuator according to claim 1, wherein the winding tip portion is extended to the outside of the spring, and the claw is formed on either side of the winding tip portion.

3. The pneumatic actuator according to claim 1, wherein the spring is positioned in a rotation direction in such a manner that a difference in the air pressure resulting from a difference in operation directions of the rod is not more than a permissible value.

4. A pneumatic actuator comprising:

a housing into which air pressure is to be applied;

a spring holder, provided within the housing, to perform a reciprocal movement along with a diaphragm by the air pressure to be applied;

a rod attached to the spring holder and reciprocally movable along with the spring holder;

a spring, provided within the housing, and contractable and extendable by the reciprocal movement of the spring holder to provide a biasing force; and a rotation limiting portion for limiting rotation of the spring, wherein a winding tip portion of the spring is bent inwardly, a convex portion is formed in the spring holder, along an inner periphery of the spring, and the rotation limiting portion is a depressed portion which is obtained by depressing a part of the convex portion and in which the winding tip portion is to be disposed.

5. The pneumatic actuator according to claim 4, wherein the spring is positioned in a rotation direction in such a manner that a difference in the air pressure resulting from a difference in operation directions of the rod is not more than a permissible value.

6. A pneumatic actuator comprising:

a housing into which air pressure is to be applied;

a spring holder, provided within the housing, to perform a reciprocal movement along with a diaphragm by the air pressure to be applied;

a rod attached to the spring holder and reciprocally movable along with the spring holder;

a spring, provided within the housing, and contractable and extendable by the reciprocal movement of the spring holder to provide a biasing force; and a rotation limiting portion for limiting rotation of the spring, further comprising a raised portion provided in the spring holder, and a convex portion provided on the raised portion and formed along an inner periphery of the spring, wherein a winding tip portion of the spring protrudes in an axial direction, and the rotation limiting portion is an insertion hole which is formed in the raised portion and into which the winding tip portion is to be inserted.

7. The pneumatic actuator according to claim 6, wherein the spring is positioned in a rotation direction in such a manner that a difference in the air pressure resulting from a difference in operation directions of the rod is not more than a permissible value.

8. A pneumatic actuator comprising:

a housing into which air pressure is to be applied;

a spring holder, provided within the housing, to perform a reciprocal movement along with a diaphragm by the air pressure to be applied;

a rod attached to the spring holder and reciprocally movable along with the spring holder;

a spring, provided within the housing, and contractable and extendable by the reciprocal movement of the spring holder to provide a biasing force; and a rotation limiting portion for limiting rotation of the spring, wherein a winding tip portion of the spring is extended to the outside, a concave portion is formed in the spring holder, along an outer periphery of the spring, and the rotation limiting portion is a depressed portion which is obtained by depressing a part of the convex portion and in which the winding tip portion is to be disposed.

9. The pneumatic actuator according to claim 8, wherein the spring is positioned in a rotation direction in such a manner that a difference in the air pressure resulting from a difference in operation directions of the rod is not more than a permissible value.

* * * * *